United States Patent [19]

Silverberg

[11] 4,050,804

[45] Sept. 27, 1977

[54] LIQUID INK IMAGING SYSTEM

[75] Inventor: Morton Silverberg, Rochester, N.Y.

[73] Assignee: Xerox Corporation, Stamford, Conn.

[21] Appl. No.: 692,838

[22] Filed: June 4, 1976

[51] Int. Cl.[2] ..... G03G 15/10

[52] U.S. Cl. ..... 355/10; 96/1 LY; 118/661; 118/DIG. 23; 355/3 R

[58] Field of Search ..... 355/3 R, 3 DR, 3 TR, 355/10, 16, 4, 3 BE; 118/661, DIG. 23; 96/1 LY; 427/15

[56] References Cited

U.S. PATENT DOCUMENTS

| | | | |
|---|---|---|---|
| 3,778,841 | 12/1973 | Gundlach et al. | 355/16 X |
| 3,790,273 | 2/1974 | Tanaka et al. | 355/16 |
| 3,924,945 | 12/1975 | Weigl | 355/10 |

FOREIGN PATENT DOCUMENTS

| | | | |
|---|---|---|---|
| 2,456,899 | 12/1975 | Germany | 355/16 |

*Primary Examiner*—Richard L. Moses

[57] ABSTRACT

An electrostatographic imaging apparatus is disclosed. The imaging apparatus includes a photoconductor assembly; means for positioning the inner surface of a dielectric web against the photoconductor whereby an air gap is formed between the photoconductor and the web; charging and exposing means; a conductive roller which is biased at a potential sufficient to prevent charge transfer from the photoconductor to the web; a liquid developing system; and means for transferring the developed image from the web to an image copy member.

4 Claims, 1 Drawing Figure

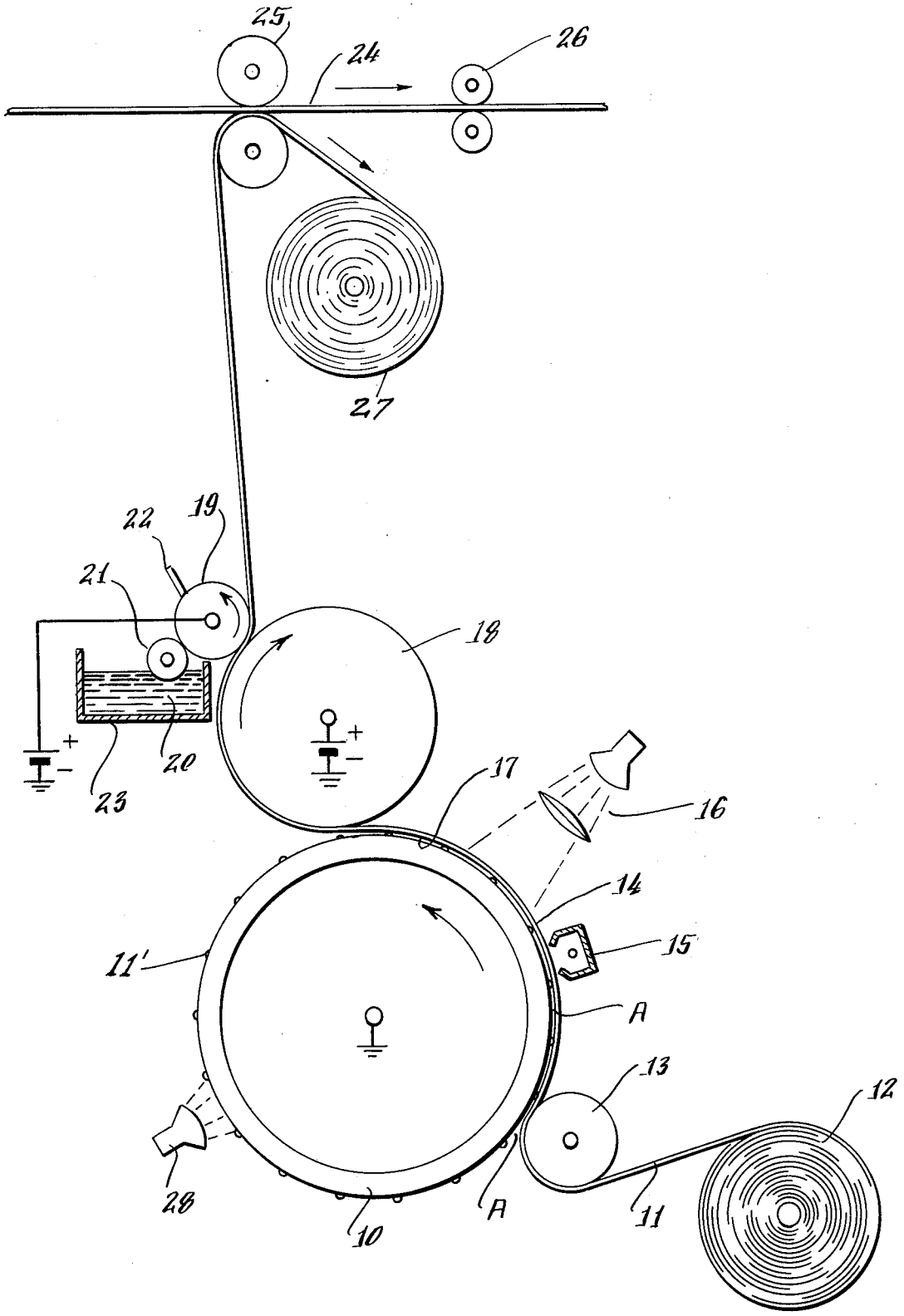
25
24
26
27
22
19
21
18
20
23
17
16
14
15
11'
A
13
12
28
10
A
11

LIQUID INK IMAGING SYSTEM

BACKGROUND OF THE DISCLOSURE

I. Field of the Invention

This invention relates to imaging systems, and more particularly, to an imaging system employing liquid ink development.

II. Description of Prior Art

The formation and development of images on the surface of photoconductive materials by electrostatic means is well known. The basic electrostatographic process, as taught by D. F. Carlson in U.S. Pat. No. 2,297,691, involves placing a uniform electrostatic charge on a photoconductive insulating layer, exposing the layer to a light and shadow image to dissipate the charge on the areas of the layer exposed to the light, and developing the resulting electrostatic latent image by depositing on the image a finely divided electroscopic material referred to in the art as "toner."The toner will normally be attracted to those areas of the layer which retain a charge, thereby forming a toner image corresponding to the electrostatic latent image. This power image may then be transferred to a support surface such as paper. The transferred image may subsequently be permanently affixed to the support surface, e.g., as by heat or pressure. Instead of latent image formation by uniformly charging the photoconductive layer and then exposing the layer to a light and shadow image, one may form the latent image directly by charging the layer in image configuration. The powder image may be fixed to the photoconductive layer if elimination of the powder image transfer step is desired.

Similar methods are known for applying the electroscopic particles to the electrostatic latent image to be developed. Included within this group are the "cascade" development technique disclosed by E. N. Wise in U.S. Pat. No. 2,618,552; the "powder cloud" technique disclosed by C. F. Carlson in U.S. Pat. No. 2,221,776; and the "magnetic brush" process disclosed, for example, in U. S. Pat. No. 2,874,063.

Development of an electrostatic latent image may also be achieved with liquid rather than dry developer materials. In conventional liquid development, more commonly referred to as electrophoretic development, an insulating liquid vehicle having finely divided solid material dispersed therein contacts the imaging surface in both charged and uncharged areas. Under the influence of the electric field associated with the charged image pattern the suspended particles migrate toward the charged portions of the imaging surface separating out of the insulating liquid. This electrophoretic migration of charged particles results in the deposition of the charged particles on the imaging surface in image configuration. Electrophoretic development of an electrostatic latent image may, for example, be obtained by flowing the developer over the image bearing surface, by immersing the imaging surface in a pool of the developer or by presenting the liquid developer on a smooth surfaced roller and moving the roller against the imaging surface.

A system is provided wherein the principles as disclosed by Walkup in U. S. Pat. No. 2,825,814 are applied in the process of the present invention. In the Walkup patent means and apparatus are disclosed for the formation of an electrostatic charge pattern or xerographic electrostatic latent image. An electric field is imposed through a photoconductive layer and to a contiguous insulating receiver while the photoconductive layer is subject to the action of a pattern of light and shadow of visible light or other activating radiaiton. The contiguous insulating surface is positioned adjacent the surface of the photoconductive layer and is spaced therefrom by an extremely minute distance such as, for example, the small gas or air gap existent in a condition of virtual contact of one surface with another. As stated by Walkup it is believed that electric charge under the influence of an applied field through the photoconductive layer and through the insulating layer migrates through the photoconductive layer preferentially at those areas exposed to activating radiation, causing deposition of charge on the insulating layer because of electric breakdown occurring in the gas gap which may exist between this insulating layer and the photoconductive surface, again under the influence of the applied field. The insulating receiver which may be an image receiving member, for example paper, may then be developed at a remote location.

Though imaging systems of the type described have been used to reproduce selected images, there is a constant need to impart to these systems a higher degree of sensitivity so as to produce higher quality images.

SUMMARY OF THE INVENTION

It is, therefore, an object of this invention to provide an imaging system employing liquid development of an electrostatic latent image on a recycling or reusable electrostatographic imaging surface.

It is another object of the present invention to provide an imaging system which will enhance image development.

It is another object of the present invention to provide an electrostatographic imaging system employing liquid development wherein a non-resuable or electrostatographic imaging surface is used and does not have to be cleaned on each imaging cycle.

It is an overall object of this invention to provide an imaging system employing the techniques of liquid development to produce high quality images.

The foregoing objects and others are accomplished in accordance with the present invention by providing an imaging system wherein the inner surface of a dielectric web is first positioned against a photoconductive surface such that an air gap is formed between the photoconductive surface and the web. A uniform charge is then applied to the outer surface of the web and a light pattern is exposed through the web. The web is then positioned in intimate contact with the photoconductive surface and a conductive roller, and separated from the photoconductive surface onto the roller, the roller being biased at a potential sufficient to prevent charge transfer from the photoconductive surface to the web. Thereafter, the electrostatic image formed on the web is developed by a liquid developing system, and the developed image is transferred to a receiving member.

BRIEF DESCRIPTION OF THE DRAWINGS

The FIGURE is a schematic illustration of an electrostatographic imaging system employing an embodiment of the method and apparatus of the present invention.

DESCRIPTION OF THE PREFERRED EMBODIMENTS

Referring more particularly to the embodiment of the present invention as illustrated in the FIGURE, the imaging system illustrated can be broadly described by the steps outlined below:

1. Contacting a photoconductive surface with a thin interposer of dielectric web leaving a small air gap between the web and the photoconductive surface.
2. Charging the other surface of the web relative to the conductive photoconductor substrate.
3. Imagewise exposure through the polyweb either after or during charging.
4. Separating the web from the photoconductive surface around a, preferably biased, conductive roller.
5. Developing the electrostatic image on the web surface that was in contact with the photoconductor while the web remains in contact with the surface of the conductive roller.

The photoconductor 10 is shown to be in the form of a rotatably mounted cylindrical drum. However, in accordance with the present invention, the photoconductor may be of any shape or geometrical configuration which permits substantially uniform contact with an interposed film or web of dielectric material 11 such that an air gap A between the surfaces of the photoconductor and the web can be maintained. It is critical to the process in accordance with the present invention that laying the dielectric web on the photoconductive surface should not eliminate the air gap between them. This gap could range from about 4 to 16 microns, and preferably, should be at about 8 microns. The air gap or spacing between the photoconductor 10 and web 11 can be maintained by, for example, etching randomly positioned spacers 11 on the photoconductor substrate.

The photoconductive materials which may be used to form the photoconductor layer can be inorganic or organic photoconductors and include, but are not limited to, selenium and selenium alloys, with or without a thin protective overlayer of insulating material; cadmium sulfide; Pacogem; cadmium sulfoselenide; phthalocyanine binder coatings; and polyvinyl carbozle sensitized with 2, 4, 7 - trinitrofluoronone. A conductive support material (not shown) is utilized in conjunction with the photoreceptors and can be formed of the conventional materials such as aluminum, brass, copper, zinc, or the like having the necessary conductive properties.

A thin film of dielectric material 11 is fed from supply roll 12 past positioning and tensioning roll 13 to prevent ripples when dielectric web 11 is brought into contact with the surface of photoconductor 10. The dielectric web 11 should be present on the surface of the photoconductor as a smooth film as completely free of ripples as possible.

Any suitable dielectric material may be employed as the interposed film or web in the practice of this invention. Typically, the web should have sufficient tensile strength and dimensional stability to enable it to be readily interposed and maintained in uniform contact with the imaging surface with an air gap A therebetween, and adequate resistivity and dielectric strength to enable development in response to an electrostatic charge pattern present on the surface of the film. To provide the necessary mechanical properties and to maintain the film in this type of contact with the imaging surface without distortion of the film, it is generally preferred that the film have a tensile strength greater than about 4,000 pounds per square inch and the percent elongation of the film be very small. Typically, the films are nonporous and from about 6 to about 75 microns in thickness. Six microns is generally the lower limit due to the general inability to mechanically handle thinner films. The upper limit of about 75 microns is generally the thickness through which development may take place without significant loss of image charge density. In addition, the voltage applied to the developer roll to induce developer transfer generally increases with the thickness of the interposed film. For film thickness greater than about 75 microns, for example, voltages greater than about 1,000 volts may be necessary. On the other hand, with increasing dielectric film thickness the handling of the film during the interposition, development, transfer and separating operations is more readily facilitated. Optimum balance between mechanical handling of the film and deterioration of image resolution is generally achieved with films having a thickness of from about 12 to about 50 microns. Preferably, we employ films having a thickness of from about 12 to 25 microns. The interposed films typically have volume resistivities greater than about $10^{10}$ ohm-cm. Typically, the interposed films have dielectric constants greater than about 2.2.

The dielectric film may comprise a single layer or multiple layers of one material on top of another. Typical specific unitary film materials include extruded or drawn polyolefin films such as polyethylene, polypropylene, and polybutene; elastomers including oil resistant neoprene, silicone elastomers and fluoroelastomers such as the copolymer of vinylidene fluoride and hexafluoro-propylene available from E. I. duPont de Nemours and Company under the tradename Viton. In addition, cast films of cellulose acetate, polycarbonate, or polystyrene; extruded films of polyethylene terephthalate as well as films of polyvinyl fluoride, polytetrafluorothylene and cellophane may be employed. Composite dielectric materials may also be employed and are particularly useful when the film is to be reused. For this purpose, barium titanate dielectric composites in which the barium titanate serves to greatly enhance the dielectric constant values of 25 to 30 are particularly useful. In addition, double layer laminated or coated films in which one component provides one property and the other component provides a second property may be employed. For example, a double layer film comprising a polyethylene terephthalate base to provide good tensile strength and a surface coating of polyvinyl fluoride providing good cleanability may be employed. While all of the above mentioned materials may be employed as the interposed film, for single use of disposable films, it is generally preferred to employ poloyolefins since these materials are readily and economically available and can provide superior antistatic and strength properties. Particularly superior imaging results are obtained with the use of biaxially oriented polypropylene since it has a high dielectric constant compared to the unoriented materials and superior tensile strength when compared to other polyolefins. The interposed dielectric film should be transparent since exposure of the imaging surface is to be through the film. When employing a resuable interposed web or film, it is generally preferred to provide one with sufficient thickness to withstand the necessary continuous mechanical handling of the film since the thicker materials produce the greater rigidity, durability, stiffness and ease in handling. Accordingly, when employing the film as a reusable web film of the order of from about 12 to about 50 microns are preferred. A particularly superior film of this thickness when employed as a reusable interposed web is a film made of polyvinyl fluoride such as Tedlar which has high dielectric constant of from about 8.5 to 9.2, allows quick charge dissipation because of its relatively low bulk resistivity, is relatively easy to clean and is stable under long term use.

The next step of the imaging process in accordance with the invention involves charging the top or outer surface 14 of dielectric web 11 relative to the conductive photoconductor substrate. This is preferably accomplished by using an AC scorotron 15. Thereafter, imagewise exposure occurs through the dielectric web either after charging, as shown in the FIGURE, or simultaneously with charging. Imagewise exposure of the web to a light and shadow pattern can be done by any suitable image projection means exemplified here schematically by image projection means 16 which focuses the image through web 11.

The electrostatic potential established by scorotron 15 on the outer surface 14 of web 11 should be such that the air gap field approaches as close as desired to the point of air breakdown. For example, for the preferred 8 micron spacing between photoconductor 10 and web 11, an air gap field of about 45 volts/micron is desired. Assuming, for example, a 10 micron thick web 11 having a dielectric constant of 3 and a 50 micron thick photoconductor having a dielectric constant of 3 are used in the system. The respective maximum voltage for the web, air gap, and photoconductor could be 150, 360, and 750 volts. The total maximum voltage between the top of the web and the photoconductor substrate would thus be 1260 volts. If this voltage is maintained, for example, during exposure by exposing through a scorotron, this full voltage will appear across the combination of the air gap and the web in the fully exposed regions. The resulting maximum voltage across the air gap, ionizes the air gap and imagewise forms a charge distribution on the bottom surface 17 of web 11.

Separation of dielectric web 11 from photoconductor 10 is performed in accordance with the present invention without the onset of air breakdown, i.e., without obtaining charge transfer from the photoconductor surface to the dielectric web. Air breakdown upon separating web 11 from photoconductor 10 would tend to deposit additional charge on the bottom surface 17 of the web ultimately resulting in image degredation and reduced development forces. Prevention of the air breakdown at this part of the system is accomplished in accordance with the embodiment illustrated in the FIGURE by keeping the web against a biased conductive backup roller 18. In accordance with the present invention we have found the roller 18 should be biased at a potential ranging from about 200 to about 300 volts.

This invention contemplates for development purposes a developing apparatus whereby as shown in the FIGURE, the developer applicator is brought into contact with dielectric web 11 while the web is being moved between roller 18 and the developer applicator. Development of the charge density on the bottom surface 17 of web 11 must be done without having air breakdown between the ink surface and the web prior to or during the development step so as to avoid reduction or elimination of the electric field required for development. This is accomplished by positioning web 11 in intimate contact with roller 18 and a biased developing apparatus, such as a gravure roller 19, and separating the web from roller 18 onto gravure roller 19. The gravure roll is preferably biased at a potential ranging from about 200 to about 300 volts, and preferably at a voltage substantially the same as the bias applied to roller 18.

Any suitable developer dispensing member may be employed. It may take the form, for example, of a gravure roller 19 as illustrated or one having a patterned surface. Porous ceramic materials and metallic sponge may also be used as the applicator device. The principal characteristics in the patterned surface form include preferably that the structure should be substantially uniform or regular in configuration having raised portions or lands and depressed portions or valleys, and that it be capable of holding developer material in the depressed portions of the pattern. A particularly effective applicator device providing uniform development is a cylindrical roll having a patterned surface which may be of a trihelicoid, pyramidal, single thread or quadragravure grooved pattern.

Any suitable liquid developer may be employed in the practice of this invention. Typically, the developers which are effective have a conductivity of from about $10^{-4}$ ohm-cm$^{-1}$ to about $10^{-14}$ ohm-cm$^{-1}$, and comprise colorants dispersed or dissolved in liquid vehicles. Typical vehicles within this group providing these properties include water, methanol, ethanol, propanol, glycerol, ethylene glycol, propylene glycol, 2, 5-hexane diol, mineral oil, the vegetable oils including caster oil, peanut oil, sunflower seed oil, corn oil, and rapeseed oil. Also included are silicone oil, mineral spirits, halogenated hydrocarbons such as Dupont's Freon solvents and Krytox oils; esters such as fatty acid esters, kerosene and oleic acid. Any suitable colorant may be employed including both dyes and pigments. Typical pigments include carbon black and other forms of finely divided carbon, quinacridones, iron oxides, zinc oxides, titanium dioxide, and benzidene yellow. In addition, as is well known in the art, the developers may contain one or more secondary vehicles, dispersants, viscosity controlling additives, or additives which contribute to fixing the developer on the copy paper.

Development and imaging is accomplished in accordance with the illustrated embodiment of this invention as shown in the FIGURE with a gravure applicator roller 19 loaded with a liquid developer 20 by means of feed roller 21 and doctored by doctor blade 22 to clean roller 19. The liquid developer may be replenished through the developer reservoir 23 by any suitable means such as gravity from a developer bath which is not depicted. It is also preferred in accordance with the present invention and as shown in the embodiment of the FIGURE that web 11 be kept in intimate contact against gravure roll 19 after passing through the regular development zone so that the highest possible print density for a given charge density on web 11, is obtained.

The developer on the interposed layer in image configuration is transferred to a receiver sheet such as ordinary paper 24, held in pressure contact with the dielectric web by means of transfer rollers 25. If desired, transfer may be electrostatically assisted. The receiver sheet bearing the developer in image configuration is thereafter fed through copy feed out rolls 26. The used dielectric web is then wound up on takeup roller 27. Any charged image pattern on the photoconductor may be dissipated by blanket illumination from lamp 28 to render the photoconductor ready for the next imaging cycle.

I claim:

1. An electrostatic imaging apparatus comprising: a photoconductor assembly; means for positioning the inner surface of a dielectric web against said photoconductor whereby an air gap is formed between said photoconductor and said web; charging means for applying a charge to the outer surface of said web; means for exposing a light pattern through said web, whereby the air gap is ionized and forms a latent image on the inner surface of the web; means for guiding the latent image bearing web away from the photoconductor, including a conductive roller, said roller being biased at a potential sufficient to prevent charge transfer from said assembly to said web; a liquid developing system for developing the latent image on said web; and means for transferring said developed image from said web to an image copy member.

2. The apparatus of claim 1 where said liquid developing system includes a gravure development roller for applying the liquid ink to said web, the gravure roller being biased at a voltage substantially the same as the bias voltage applied to said conductive roller.

3. The apparatus of claim 1 wherein said means for forming said air gap comprises a plurality of randomly positioned spacers on the top surface of said photoconductor assembly.

4. The apparatus of claim 1 wherein said photoconductor assembly is in the form of a rotatable, cylindrical drum.

* * * * *